US007614089B2

(12) United States Patent
Hillman-Schwartz et al.

(10) Patent No.: US 7,614,089 B2
(45) Date of Patent: Nov. 10, 2009

(54) COVER FOR PROTECTING AN EAR

(75) Inventors: Marsha Hillman-Schwartz, P.O. Box 740513, Boynton Beach, FL (US) 33474; Kari Ayn Heitzner, Haworth, NJ (US)

(73) Assignees: Kari A. Heitzner, Haworth, NJ (US); Marsha Hillman-Schwartz, Haworth, NJ (US)

( * ) Notice: Subject to any disclaimer, the term of this patent is extended or adjusted under 35 U.S.C. 154(b) by 69 days.

(21) Appl. No.: 11/786,283

(22) Filed: Apr. 11, 2007

(65) Prior Publication Data

US 2007/0245459 A1 Oct. 25, 2007

Related U.S. Application Data

(60) Provisional application No. 60/792,194, filed on Apr. 17, 2006.

(51) Int. Cl.
*A45D 44/12* (2006.01)

(52) U.S. Cl. ..... 2/174; 2/209; 128/866

(58) Field of Classification Search ..... 2/209, 2/174, 423; 128/866, 864
See application file for complete search history.

(56) References Cited

U.S. PATENT DOCUMENTS 243,168 A * 6/1881 Spitz ..... 2/209
3,452,365 A * 7/1969 Wallace ..... 2/209
4,134,153 A * 1/1979 Voorhees ..... 2/174
4,616,643 A 10/1986 Jung
4,660,229 A 4/1987 Harris
5,718,001 A 2/1998 Wright
5,778,455 A 7/1998 Joseph
5,835,609 A 11/1998 LeGette
5,887,286 A 3/1999 Waldron
5,920,912 A 7/1999 Patchett
6,041,440 A 3/2000 Jackson
6,237,157 B1 5/2001 Lobbins
D443,730 S * 6/2001 Tsujino ..... D29/112
6,298,493 B1 10/2001 Ambroise
6,944,886 B1 * 9/2005 Jackson ..... 2/209

* cited by examiner

*Primary Examiner*—Katherine Moran
*Assistant Examiner*—Richale L Quinn

(57) ABSTRACT

An outer covering for protecting an ear includes a water-resistant material forming a pouch for protecting an ear from moisture intrusion wherein the pouch has a curved opening disposed along an edge of the pouch for receiving the ear there into, thereby forming a kidney shape for the pouch when viewed from a side view, wherein the curved opening is capable of being stretched over the ear and returning to a substantially consistent dimension and shape and fitting around and adhering the pouch to the ear.

5 Claims, 7 Drawing Sheets

COVER FOR PROTECTING AN EAR

CROSS-REFERENCE TO RELATED APPLICATIONS

This application is based on, and claims priority from prior U.S. Provisional Patent Application No. 60/792,194, filed on Apr. 17, 2006, the entire teachings thereof being hereby incorporated by reference in its entirety.

FIELD OF THE INVENTION

The present invention relates generally to the protection of ears, and more particularly relates to a device for protecting ears from moisture intrusion.

BACKGROUND OF THE INVENTION

The ear is the sense organ of the body that detects sound and equilibrium in most vertebrates. The word "ear" may be used correctly to describe the whole ear, or just the visible portion. In humans, and almost all vertebrates, the only visible portion of the ear is the outer ear. Referring to FIG. 1, shown is a cross-sectional view of a human ear. The outer ear includes the pinnae 102 (also called auricle), the ear canal 104, and the very most superficial layer of the ear drum (also called the tympanic membrane) (not shown). The complicated design of the human outer ear and the ear canal helps capture and guide sound toward the ear drum. Unfortunately, this same design, which is efficient at collecting sounds, is also efficient at guiding liquids into the ear canal as well.

Not only can moisture present in the ear canal be an annoyance, it can oftentimes result in infection and injury and problems with balance and equilibrium. Examples of common situations where moisture intrusion can occur includes water introduced during showers and baths, water introduced while having one's hair washed at a beauty salon, water introduced during rainstorms, chemicals introduced during hair dying or curling, blood introduced during a surgery, and many others. In addition to damage or annoyance that can be caused to the ear itself, there are other reasons one may wish to avoid moisture intrusion into the ear. One such reason is the presence of an electronic hearing aid. For most hearing aids, moisture can easily ruin or damage the aid and should be strictly avoided. Another such reason for avoiding moisture intrusion in the ear is the presence of cotton or other materials present in the ear for the purpose of healing the ear or protecting the ear.

Some ear covers have been developed that attempt to protect the ear from moisture. One such cover is a miniature shower-cap-shaped plastic cover with a round opening. The opening is intended to be placed over the pinna and rest on the portion of the outer ear that makes contact with the head. This portion 100 is shown in FIG. 1. However, the round opening does not properly follow the oblong shape of the outer ear and does not fit securely against the portion 100 of the ear that meets the head. In addition, this prior-art device is made of a plastic material that is baggy, non-stretchy, and does not conform to the human ear. Furthermore, it is difficult to remove once it has been placed over the ear. This is especially true when the device is wet.

Other devices provide draw strings and/or chin straps and other methods of placing tension on the ear covers, thereby causing them to stay on the head. However, these covers are complicated, expensive to make, time consuming to apply, and difficult to use. In addition, the covers with chin straps allow moisture to enter the ear at certain angles, since the tension is only placed on the covers from one direction.

Therefore a need exists to overcome the problems with the prior art as discussed above.

SUMMARY OF THE INVENTION

Briefly, in accordance with the present invention, disclosed is an outer cover for protecting an ear. The device includes a water-resistant material forming a pouch for protecting an ear from moisture intrusion. The device also includes a curved opening disposed along an edge of the pouch for receiving the ear there into, thereby forming a kidney shape for the pouch when viewed from a side view, wherein the curved opening is capable of being stretched over the ear and returning to a substantially consistent dimension and shape and fitting around and adhering the pouch to the ear.

In accordance with another feature, an embodiment of the present invention includes a loop following the curved opening, where the loop is capable of being stretched and returning to a substantially consistent dimension and fitting around and adhering the water-resistant pouch to an ear.

In accordance with a further feature of the present invention, a tab is coupled to the loop, where the tab is provided for causing the loop to stretch when the tab is pulled.

In accordance with a further feature of the present invention, the water-resistant material is capable of being stretched and returning to a substantially consistent dimension and shape.

In accordance with the present invention, a method for protecting an ear, includes covering an ear with an ear cover, where the ear cover is made of a water-resistant material forming a water-resistant pouch for protecting an ear. The ear cover has a curved opening in the pouch rendering the pouch kidney shaped and the curved opening capable of being stretched and returning to a substantially consistent dimension and shape and fitting around and adhering the water-resistant pouch to an ear.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
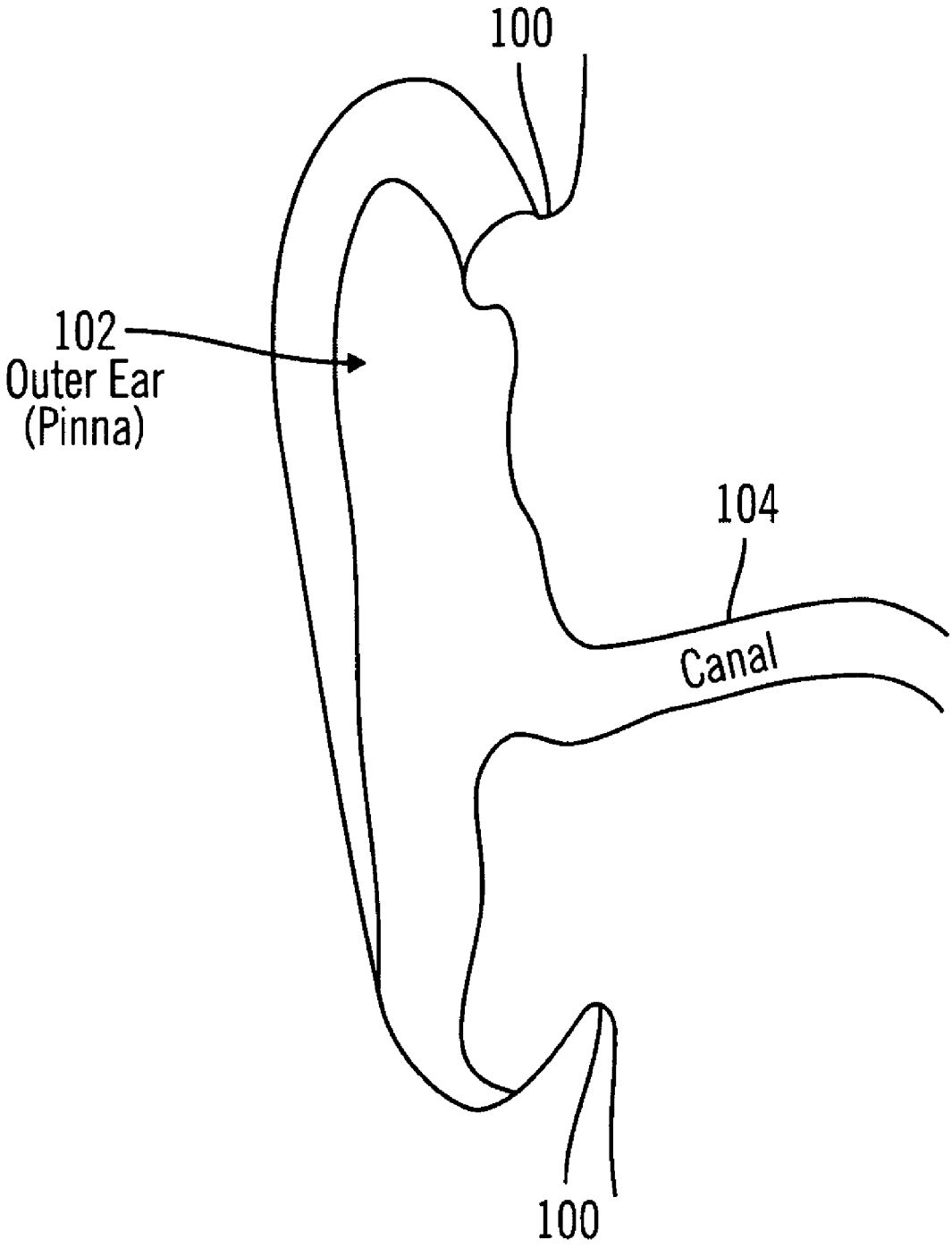
FIG. 1 is a side cross-sectional view of an outer human ear.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The present invention, according to an embodiment, overcomes problems with the prior art by providing an ear covering device that is constructed of a stretchable material that conforms to an ear. The inventive cover has an opening defined by an edge that is lined with an elastic band that tightly couples the cover to the base 100 of the human ear.

Described now is an exemplary ear-covering device for use with embodiments of the present invention.

Figure 2:
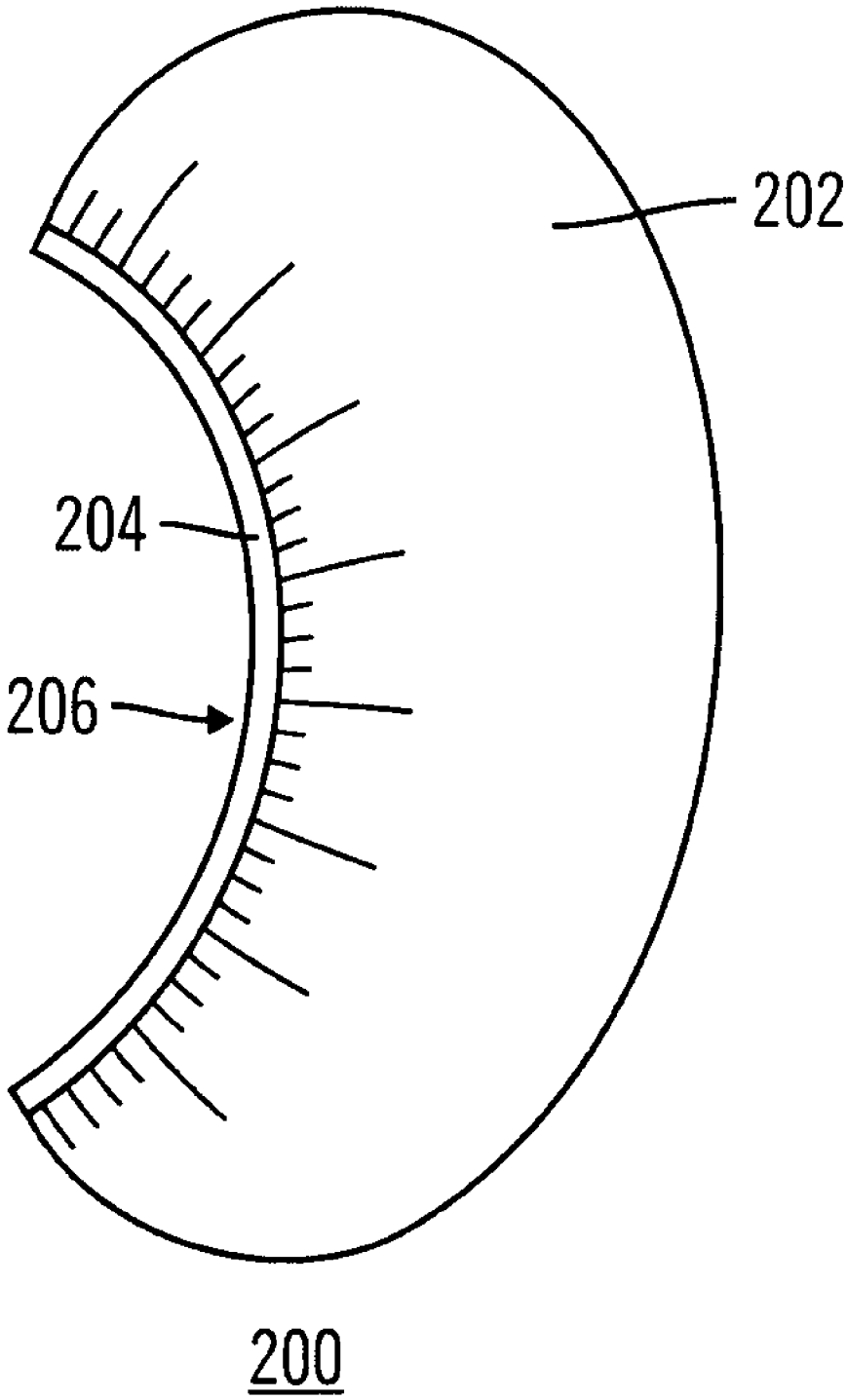
FIG. 2 is a side view of a protective ear cover in accordance with the present invention.

Referring now to FIG. 2, a side view of one embodiment of the present invention is shown. The embodiment shown provides an ear cover 200 that includes a pouch of water-proof, or at least water-resistant, material 202 that is formed in the shape of a kidney. The terms "water proof" and "water resistant," as used herein, are intended to mean a material that prevents water from passing through the material from a first side to a second side of the material. A "kidney shape" is defined herein as the well-known C-type shape of the human kidney organ. This shape can be seen in FIG. 2.

In one embodiment of the present invention, the inside edge 206 of the kidney shape is lined with a loop 204, which can be, for example, a band of elastic or other similarly stretchable material. This stretchable band is advantageous in that it allows the inside edge 206 of the ear cover 200 to be expanded so as to fit around the outer ear 102 of FIG. 1 and then be automatically contracted into a smaller diameter opening and fit snuggly around the base portion 100 of the ear that meets the head. In this way, the ear cover 200 adheres the ear 102. The term "adhere," as used herein, means to fit to the natural shape of the ear so as not to fall off easily.

The oblong kidney shape of the present invention allows it to follow the natural shape of the ear, which is also oblong. This natural fit avoids areas of unnecessary extra material, which bags up and is easily unintentionally hit or pulled and may be uncomfortable.

Figure 3:
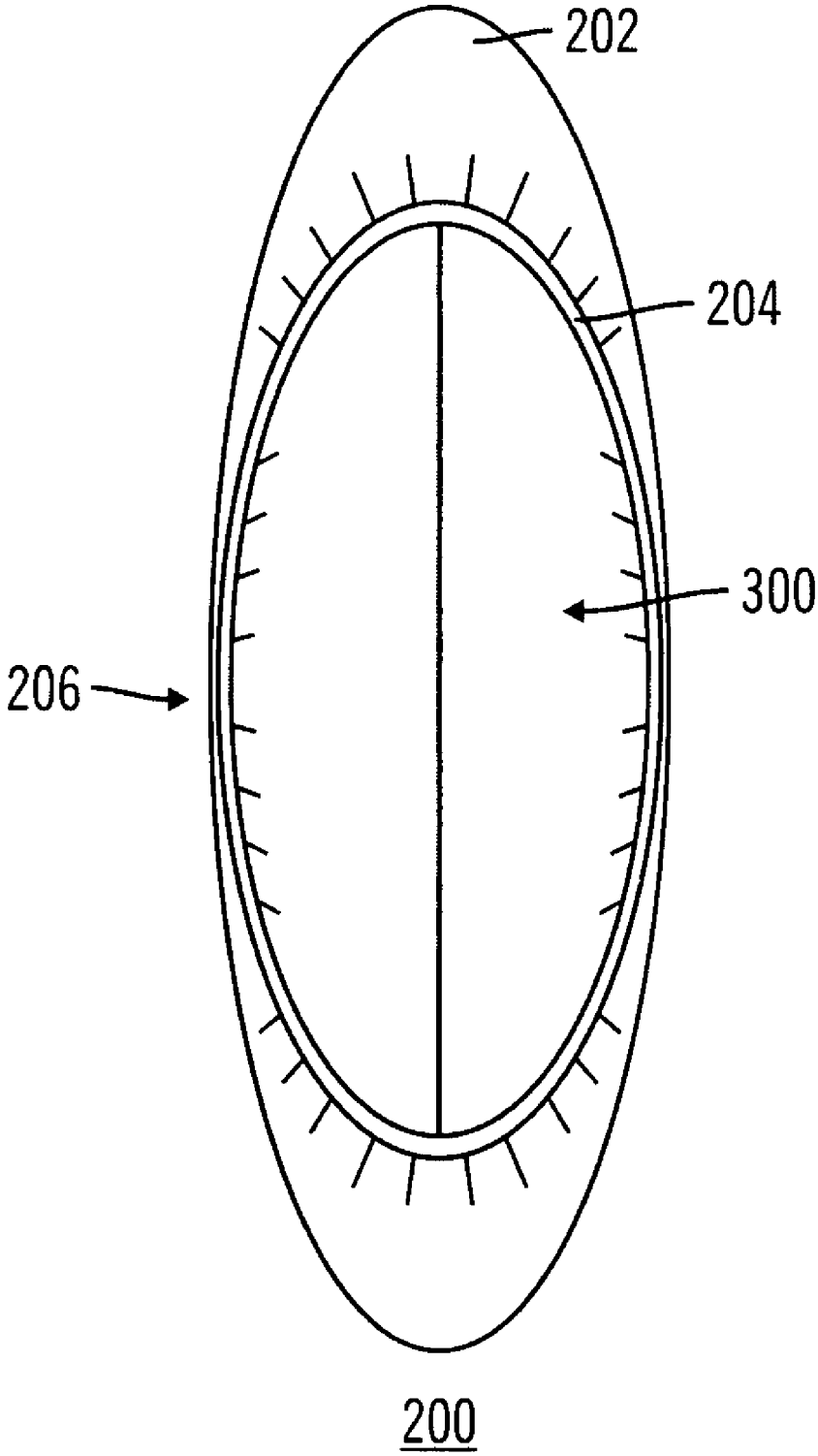
FIG. 3 is a front view of the protective ear cover of FIG. 2 in accordance with an embodiment of the present invention.

Referring now to FIG. 3, a front view of the ear cover of FIG. 1 is shown, according to one embodiment of the present invention. The view of FIG. 3 is looking directly into an opening 300 formed by the inside edge 206 of the kidney-shaped ear protector 200. The opening 300 accommodates the pinna, or outer portion of an ear. In other words, the outer portion of an ear will be substantially completely covered and protected from moisture because it is inside the pouch 300 formed by the water-resistant material 202.

Figure 4:
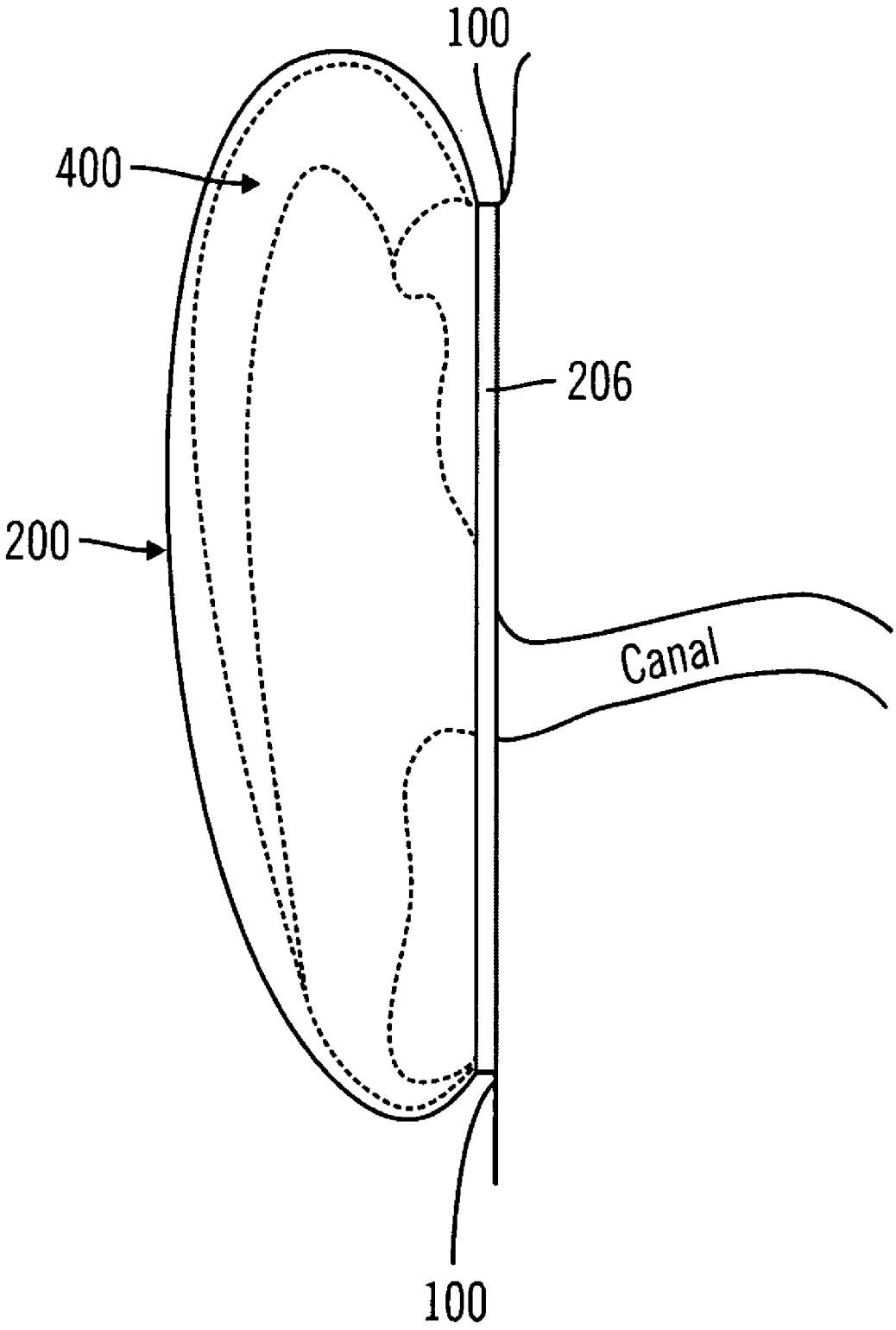
FIG. 4 is a side view of the protective ear cover of FIGS. 2 and 3 covering the outer ear of FIG. 1 in accordance with an embodiment of the present invention.

Because the edge 206 of the cover 200 is stretchable, the edge 206 may become wider and fit around the outer ear and then contract again to its original shape and dimension and fit snuggly around the base 100 of the ear. The ear is then surrounded and shielded from water by the water-proof material 202. This is shown in FIG. 4, where the ear cover 200 is placed over an ear 400. As can be seen, the edge 206 fits snuggly against the base 100 of the ear 400. The ear canal is now protected by the cover 200 from any type of moisture intrusion. Embodiments of the present invention may be used, for example, in hair salons, operating rooms, saunas, showers, rain storms, and many others.

In one embodiment, the water-proof material 202 is a flexible, bendable, stretchable plastic. Stretchable plastic materials are thin flexible membranes that may be deformed and, upon release of the deforming force, will return to their original shape and dimension. These materials are known in the art and used for applications such as trash bags and plastic wraps for storing food items. By utilizing a stretchable plastic material for the water-proof material 200, the material may be stretched to fit snuggly over the outside portion of the ear. A snug fit not only provides improved comfort over the prior art devices, but also provides improved water resisting ability and lessens the probability of the ear cover being accidentally removed due to contact with a person or object.

Figure 5:
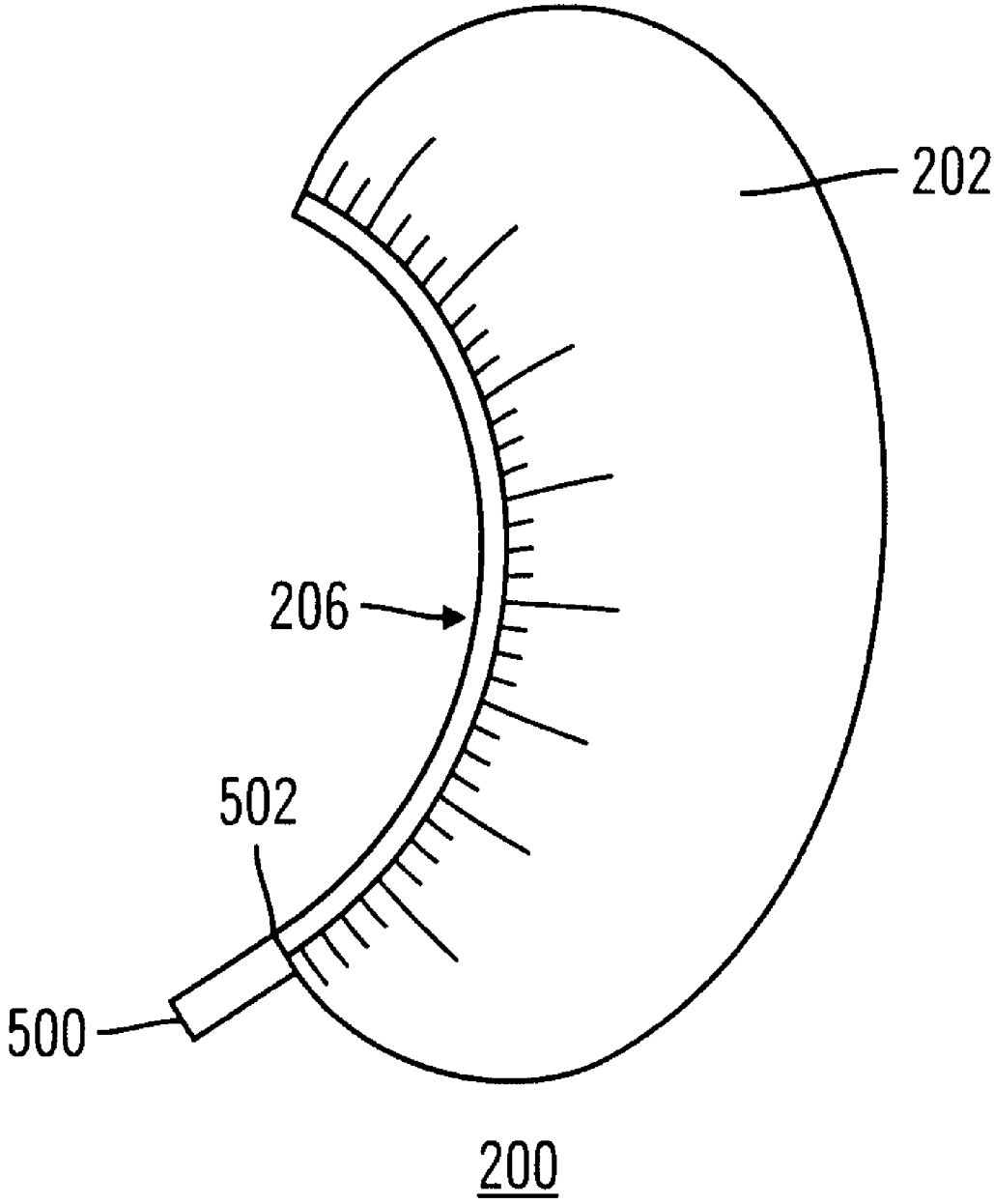
FIG. 5 is a side view of an alternate embodiment of the protective ear cover of FIG. 2 with a tab attached in accordance with one embodiment of the present invention.

In another embodiment of the present invention, as shown in FIG. 5, a tab 500 is attached to the ear cover 200 along the edge 206. The tab 500 may be made of any material and be any shape, but is, in one embodiment, a small length of material formed into a loop. In some embodiments, the tab 500 is simply an extension of the elastic material that forms the loop 204, where stitching 502 creates an extra loop portion that defines the tab 500. The tab 500 is easy for a user to grasp between their fingers or, alternatively, they can insert their finger inside of the loop. When the cover 200 is wet, and especially when it is constructed of stretchable of flexible plastic material that fits snuggly against the ear, the cover 200 may be relatively difficult to pull off of the ear. Also, chemicals, such as dyes or other coloring chemicals, may be on the cover 200 that a user wishes to avoid contact with. The tab 500 provides a great advantage in that it makes the cover 200 easy to remove. A simple tug on the tab 500 causes the edge 206 of the cover to stretch and allows the ear to escape from within the pouch 300.

In another embodiment, a second tab is attached to a side of the edge 206 opposite the first tab 500. The second tab allows the cover 200 to be more easily removed because both tabs may be pulled in opposite directions allowing the inside edge 206 to expand and release the ear 102.

Figure 6:
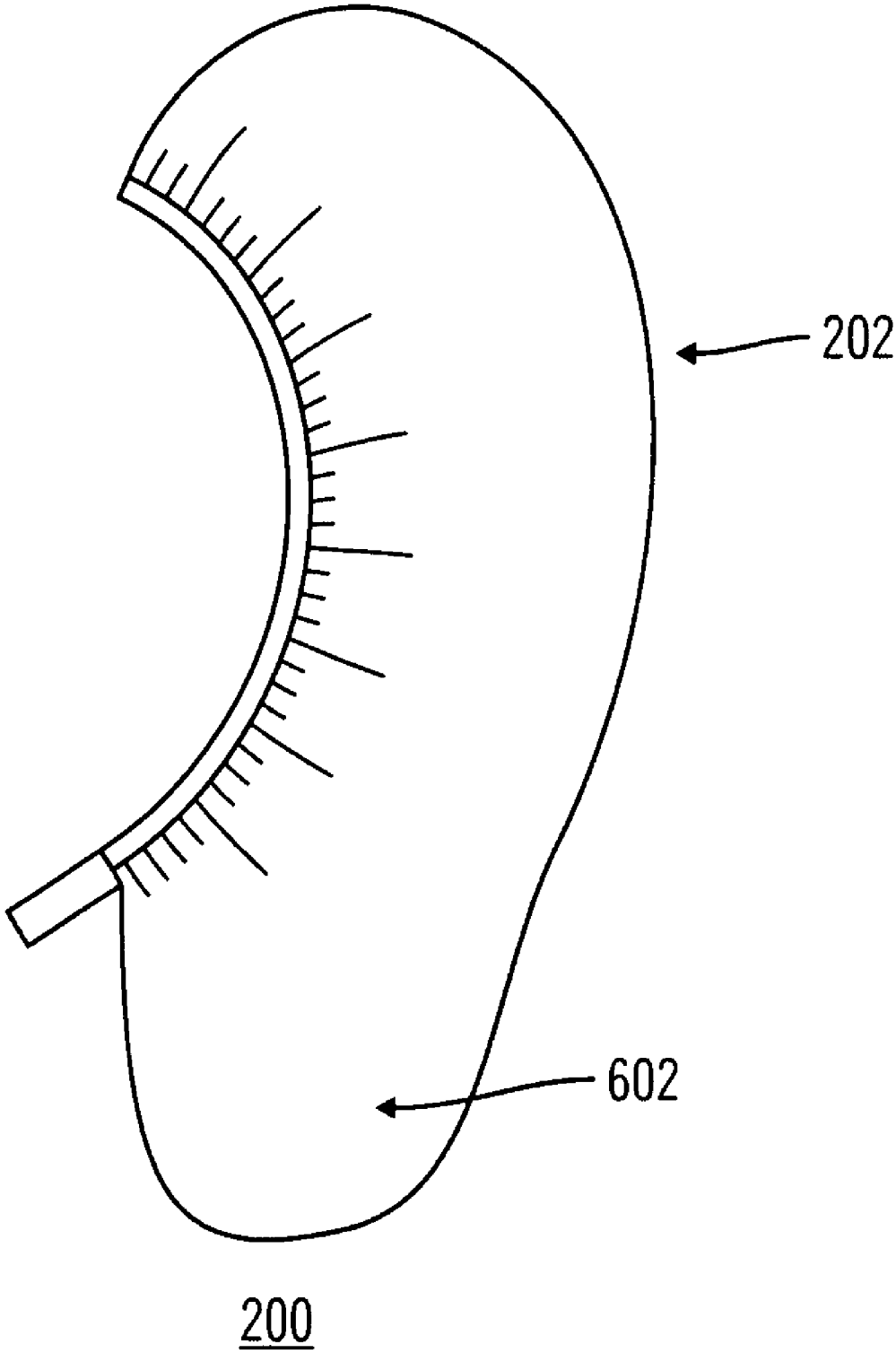

FIG. 6 shows one additional embodiment of the present invention. In the embodiment of FIG. 6, the ear cover 200 is provided with an extra pouch area 602 of the main pouch 202. The extra pouch area 602 creates a small pocket in the material making up the main pouch 202. This extra pouch area 602 is useful for accommodating those users that are wearing earrings or otherwise do not want their earlobes in close direct contact with the material making up the pouch 202.

Figure 7:
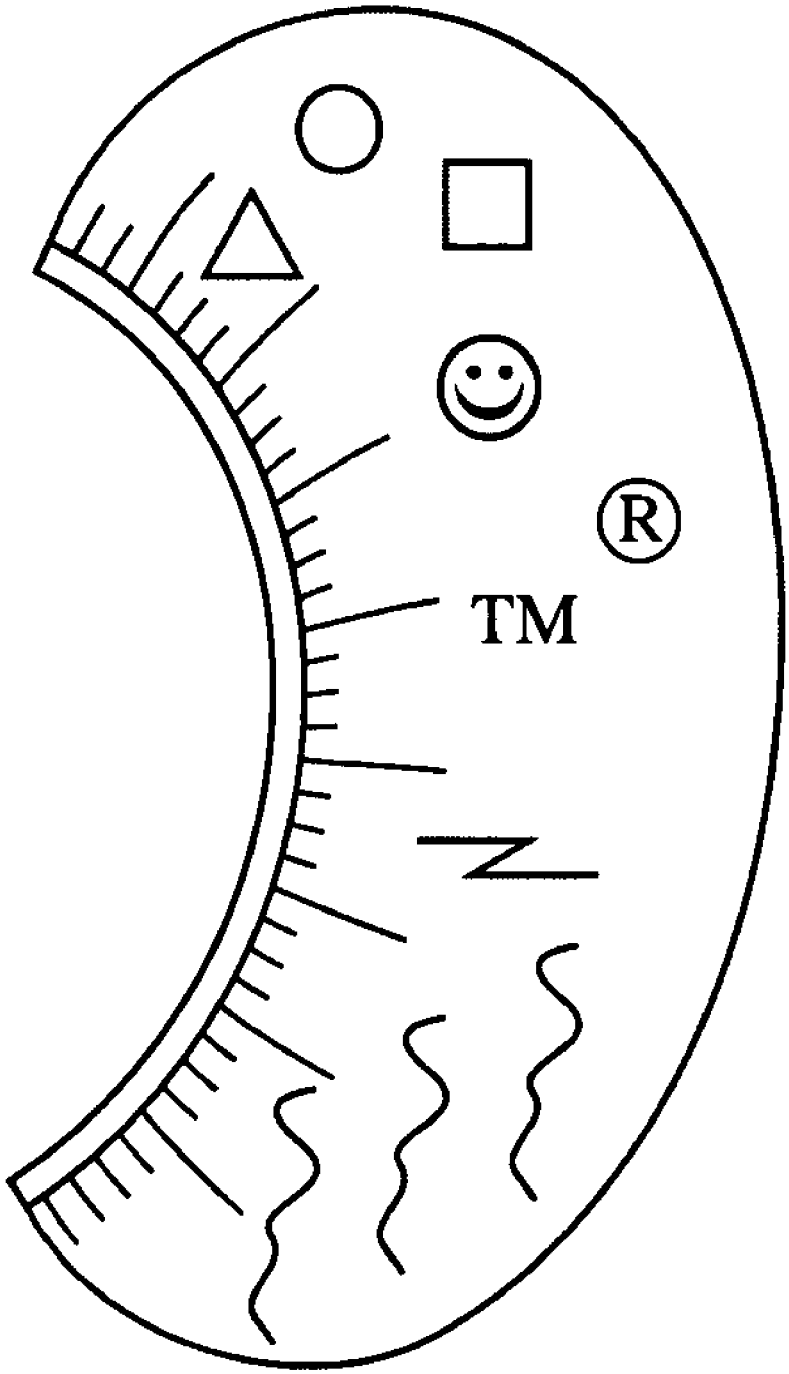

In still other embodiments, the outer covering 200 for protecting an ear may be provided with various sizes of openings 206 to accommodate users of various sizes. In addition, the outer covering 200 for protecting an ear may be provided with a graphic design, such as characters, figures, logos, and other types graphics on its outer surface. A few examples are shown in FIG. 7. The graphics are advantageous in that children may like characters, such as Disney characters on their ear protectors, while adults may prefer more sophisticated designs, such as Ralph Lauren trademarked designs. These are only a few examples and the present invention is not so limited.

A protective ear cover has been described. The cover has been discussed with reference to human ears; however the invention is not so limited and may also be used on animals. The inventive cover protects the ear from intrusion of moisture, which may include water, soap, chemicals and the like. The covers can be provided in varying sized to accommodate a plurality of ear sizes. In addition, the material used for the cover can be transparent, so that water intrusion can be visually observed, or can be any color, pattern, and degree of opaqueness. Embodiments of the present invention are advantageous in that they provide a cover that is disposable, easy to store, and, therefore, very utilitarian and practicable in design and size.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

What is claimed is:

1. An outer covering for protecting an ear, the outer covering comprising:

a water-resistant material forming a transparent pouch for protecting an ear from moisture intrusion, the pouch having:

a curved opening disposed along an edge of the pouch for receiving the ear there into, thereby naturally forming a kidney shape for the pouch when viewed from a side view; and a length of elastic material having a first portion disposed around the curved opening thereby forming a first loop and having a second portion extending beyond the opening thereby providing a second loop that is shaped to receive a single finger of a wearer, wherein the curved opening is capable of being stretched over the ear and returning to a substantially consistent dimension and shape and fitting around and adhering the pouch to the ear creating a water-proof interior and capable of being stretched and removed from the ear by a single finger inserted into and exerting force on the second loop.

2. The outer covering according to claim 1, wherein the water-resistant material is capable of being stretched and returning to a substantially consistent dimension and shape.

3. The outer covering according to claim 1, wherein the water-resistant material is transparent.

4. The outer covering according to claim 1, further comprising:

a lower pouch area defining a pocket in the pouch.

5. An outer covering for protecting an ear, the outer covering comprising:

a water-resistant material forming a transparent pouch for protecting an ear from moisture intrusion, the pouch having:

a curved opening disposed along an edge of the pouch for receiving the ear therein, thereby naturally forming a kidney shape for the pouch when viewed from a side view;

a first length of elastic material disposed around the curved opening and forming a first loop; and a second length of elastic material adjacent the first loop and physically coupled to the curved opening and forming a second loop that is shaped to receive a single finger of a wearer, wherein the curved opening is capable of being stretched over the ear and returning to a substantially consistent dimension and shape and fitting around and adhering the pouch to the ear creating a water-proof interior and capable of being stretched and removed from the ear by a single finger inserted into and exerting force on the second loop.

* * * * *